US005322076A

United States Patent [19]

Brinkley et al.

[11] Patent Number: 5,322,076

[45] Date of Patent: Jun. 21, 1994

[54] PROCESS FOR PROVIDING TOBACCO-CONTAINING PAPERS FOR CIGARETTES

[75] Inventors: Paul A. Brinkley, Winston-Salem; Cynthia L. Davis, Mocksville; Mark L. Raker, Clemmons; James S. Thomasson, Statesville, all of N.C.

[73] Assignee: R. J. Reynolds Tobacco Company, Winston-Salem, N.C.

[21] Appl. No.: 833,193

[22] Filed: Feb. 6, 1992

[51] Int. Cl.[5] ..... A24B 3/14

[52] U.S. Cl. ..... 131/374; 131/370; 131/372

[58] Field of Search ..... 131/374, 365, 370, 353–358, 131/372, 297; 162/99, 382

[56] References Cited

U.S. PATENT DOCUMENTS 1,068,403 7/1913 Maier .
2,893,400 7/1959 Detert et al. ..... 131/358
3,415,253 12/1968 Michels et al. ..... 131/374 X
4,005,718 2/1977 Prouse et al. ..... 131/374 X
4,270,552 6/1981 Jenkins et al. .
4,421,126 12/1983 Gellatly .
4,674,519 6/1987 Keritsis et al. .
4,941,484 7/1990 Clapp et al. .
4,962,774 10/1990 Thomasson et al. .
4,972,854 11/1990 Kierman et al. .
4,987,906 1/1991 Young et al. .
5,056,537 10/1991 Brown et al. .
5,078,156 1/1992 Furuya et al. ..... 131/374

OTHER PUBLICATIONS

*Tobacco Encylopedia,* Edited by Voges, pp. 389–390 TJI (1984).

Silberstein, TJI, vol. 1, pp. 26–29 (1985).

*Primary Examiner*—Jennifer Doyle

*Attorney, Agent, or Firm*—Grover M. Myers

[57] ABSTRACT

A tobacco-containing paper is provided using a reconstituted tobacco material as a component thereof. A reconstituted tobacco material, provided using papermaking techniques from a refined tobacco pulp, is refined into a pulp form and provided as a slurry in water. The slurry is combined with inorganic filler (e.g., calcium carbonate particles) and cellulosic pulp (e.g., wood pulp). The resulting slurry is then employed to provide a paper using papermaking techniques. The tobacco-containing paper has many desirable physical characteristics.

7 Claims, 1 Drawing Sheet

PROCESS FOR PROVIDING TOBACCO-CONTAINING PAPERS FOR CIGARETTES

BACKGROUND OF THE INVENTION

The present invention relates to smoking articles such as cigarettes, and in particular, to processed tobacco-containing materials useful as components for such smoking articles.

Popular smoking articles, such as cigarettes, have a substantially cylindrical rod shaped structure and include a charge of smokable material such as shredded tobacco (e.g., in cut filler form) surrounded by a paper wrapper thereby forming a so-called "tobacco rod." Normally, a cigarette has a cylindrical filter element aligned in an end-to-end relationship with the tobacco rod. Typically, a filter element includes cellulose acetate tow circumscribed by plug wrap, and is attached to the tobacco rod using a circumscribing tipping material. It also has become desirable to perforate the tipping material and plug wrap, in order to provide dilution of drawn mainstream smoke with ambient air.

Certain cigarettes include tobacco-containing papers as components thereof. Such tobacco-containing papers are employed as substrates for flavors, as smokable filler, as wrappers for tobacco rods and as components for filter elements. Exemplary tobacco-containing papers and smoking articles incorporating such papers are described in U.S. patent application Ser. Nos. 661,747, filed Feb. 27, 1991, 759,266, filed Sep. 13, 1991, 642,233, filed Jan. 23, 1991 and 723,350, filed Jun. 28, 1991; in U.S. Pat. Nos. 4,991,596 to Lawrence, et al., 5,025,814 to Raker, 5,065,776 to Lawson, et al., 5,027,837 to Clearman, et al. and 4,924,883 to Perfetti, et al.; in Canadian Patent No. 1,271,389; in European Patent Application No. 432,927 and in *Chemical and Biological Studies on New Cigarette Prototypes That Heat Instead of Burn Tobacco*, R.J. Reynolds Tobacco Company (1988).

It would be desirable to provide a process for manufacturing a tobacco-containing paper useful as a component for smoking articles.

SUMMARY OF THE INVENTION

The present invention relates to a process for providing tobacco-containing paper. The process involves providing a reconstituted tobacco material, preferably using a papermaking technique; and then using that reconstituted tobacco material to provide at least a portion of the cellulosic component of paper which is manufactured using papermaking techniques.

The papers of the present invention can be used to make cigarettes as described in U.S. patent application Ser. Nos. 609,975, filed Nov. 6, 1990, now U.S. Pat. No. 5,156,169, 756,023, filed Sep. 6, 1991 and 759,266, filed Sep. 13, 1991; gathered as described in U.S. Pat. No. 4,807,809 to Pryor, et al. and U.S. patent application Ser. No. 723,350, filed Jun. 28, 1991; shredded as described in U.S. Pat. No. 5,025,814 to Raker; or used as described in U.S. Pat. No. 5,065,776 to Lawson, et al.; which are incorporated herein by reference.

DETAILED DESCRIPTION OF THE PREFERRED EMBODIMENTS

Figure 1:
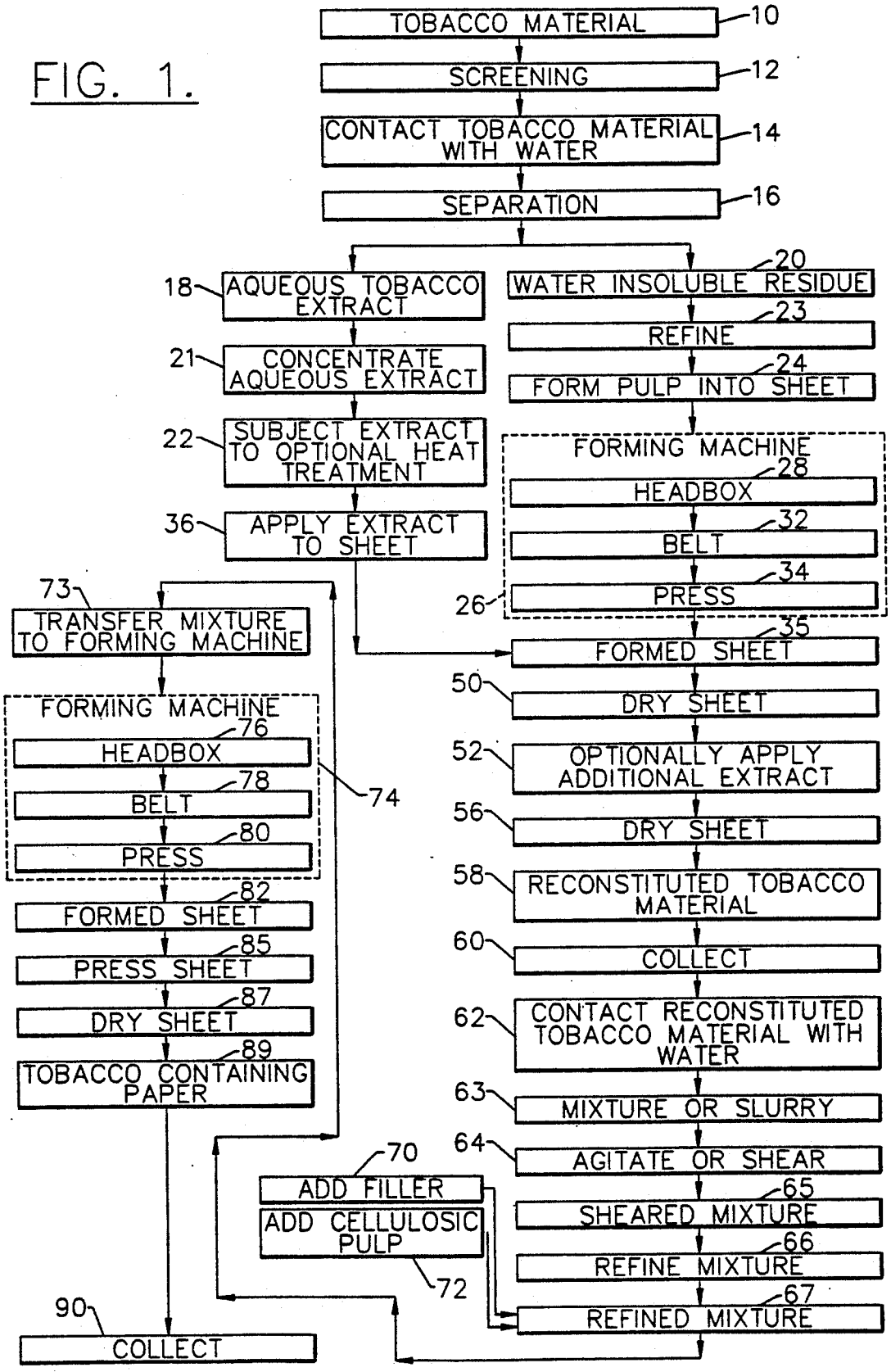
FIG. 1 in a schematic diagram of steps representative of an embodiment of the present invention.

Referring to FIG. 1, tobacco material 10 can have the form of stem, dust, scrap, cut filler, strip, or the like. One or more of the aforementioned exemplary tobacco materials can be provided separately, or as blends thereof. The tobacco material can be screened 12 or otherwise processed to remove impurities (e.g., sand) therefrom. Techniques for removing particular impurities from particular tobacco materials can vary, depending upon factors such as the form of the tobacco material being processed; and such techniques will be apparent to the skilled artisan.

The tobacco material is contacted with water 14 under conditions such that water soluble components of the tobacco are extracted by the water. The mixture, which is an aqueous tobacco slurry, is subjected to separation conditions 16 so as to provide extracted tobacco components in an aqueous phase 18 and a water insoluble residue 20. The manner of separation of the liquid extract from the insoluble residue can vary. Typical separation techniques involve centrifugation, the use of one or more passes of the mixture through a disc press or screw press, or the like. If desired, the liquid extract can be filtered or centrifuged to provide a liquid extract essentially absent of insoluble materials and precipitates. The liquid extract preferably is concentrated 21 using evaporation techniques, or the like. For example, the liquid extract can be passed over steam-filled tubes, passed through steam-jacketed tubes, or concentrated using a forced circulation evaporator. If desired, the resulting concentrated extract can be subjected to heat treatment 22 (e.g., subjected to a temperature of about 180° F. to about 250° F. for about 10 minutes to about 90 minutes). Normally, such optional heat treatment is provided under ambient pressure or slight vacuum conditions. Optionally, the resulting concentrated extract is filtered using a screening technique, or the like, in order to remove suspended solid materials from the liquid extract.

The water insoluble residue 20 can be refined 23 using papermaking type refiners such as disc refiners, conical refiners, or the like. The refining of the water insoluble tobacco residue can vary, depending upon the desired fiber characteristics thereof, and the manner in which the residue is refined will be apparent to the skilled artisan. As such, the residue is subjected to a size reduction step and thereby is formed into pulp 24 for use in the subsequent manufacture of a reconstituted tobacco product. The pulp 24 is transferred to a forming machine 26 consisting of a headbox 28, a continuous fabric or wire mesh belt 32, and a series of presses 34. Such a forming machine is common in the papermaking industry. The selection of the forming machine, the selection of the continuous belt and the operation of the forming machine will be apparent to the skilled artisan. The pulp is laid onto the fabric or wire mesh belt 32 (e.g., after being laid onto a forming cylinder), and is thereby formed into a sheet-like shape 35. Excess water is released from the pulp using the series of presses or press rolls 34 after initial dewatering on the fabric or wire belt. Preferably, forming water removed from the pulp through the fabric or wire belt is recycled back to the headbox to provide a desirably diluted pulp which is in turn laid onto the belt.

The liquid extract then most preferably is applied 36 to the formed sheet of pulp 35 on the fabric or wire mesh belt 32 using a spraying technique, or a similar application means (e.g., size press techniques). For example, liquid tobacco extracts which are metered continuously into a reservoir are sprayed therefrom onto the pulp. The amount of extract applied to the pulp can vary, and can be selected as desired by the skilled artisan. The selection of spraying apparatus will be apparent to the skilled artisan.

The sheet-like pulp having the liquid extract applied thereto is passed through a dryer 50 such as an apron dryer, or the like. If desired, a further amount of the liquid extract 52 can be applied to one or both sides of the resulting dried sheet, and the resulting reconstituted tobacco material can be passed through another dryer 56. Alternatively, the resulting reconstituted tobacco material can be passed through the dryer or dryers more than one time. The dried reconstituted tobacco material 58 which results can be collected 60, and is used in further steps of the process of the present invention.

The dried reconstituted tobacco material 58 is contacted with water 62 so as to provide an aqueous tobacco slurry. The resulting mixture 63 of tobacco material 58 and water 62 can be subjected to agitation or shearing 64 using a conventional paper re-pulping apparatus in order to provide a mixture of a liquid tobacco extract and a water insoluble pulp. For example, the tobacco material can be contacted with water in a container having a plurality of shearing propellers so that the pulp of the reconstituted tobacco material can be converted back to a dispersed fiber state. Other milled, shearing or mixing apparatus for converting the formed reconstituted tobacco material into a slurry of dispersed tobacco fibers will be apparent to the skilled artisan. The pulp portion of the resulting mixture 65 can be refined 66 using techniques known in the papermaking industry. The resulting pulp is used to manufacture a paper using conventional papermaking or Fourdrinier techniques. Refined mixture 67 can be combined with inorganic filler 70 (e.g., particles of calcium carbonate) and/or cellulosic material 72 (e.g., wood pulp). That mixture is transferred 73 to a forming machine 74 consisting of a headbox 76, a fabric or wire mesh screen 78, and at least one press 80. The pulp and filler are laid onto the screen 78, and water is passed therethrough to provide pulp and filler in a sheet-like shape 82. Excess water is squeezed 85 from the pulp and filler using the press, and the pulp and filler so provided is dried 87 to provide a tobacco-containing paper 89. The paper is collected 90 for use in the manufacture of smoking articles.

The tobacco materials which are reconstituted according to the present invention are of a form such that, under extraction conditions, a portion thereof is soluble in (i.e., extracted by) the extraction solvent; and a portion thereof is insoluble in (i.e., not extracted by) the extraction solvent. Examples of suitable types of tobaccos include flue-cured, Burley and Maryland tobaccos, although other types of tobacco can be employed. The tobacco material generally has been aged, and can be in the form of laminae and/or stem, or can be in a processed form. Typically, the tobacco material employed is a waste material and/or processing by-product such as fines, dust, scrap or stem. All or part of the tobacco material can be previously cased and/or top dressed. The aforementioned materials can be processed separately, or as blends thereof.

The tobacco material to be reconstituted is contacted with a solvent having an aqueous character. Such a solvent consists primarily of water, normally greater than 90 weight percent water, and can be essentially pure water in certain circumstances. Essentially pure water incudes deionized water, distilled water and tap water. However, the solvent can include water having substances such as pH buffers or the like dissolved therein. The solvent also can be a co-solvent mixture of water and minor amounts of one or more solvents which are miscible therewith. An example of such a co-solvent mixture is a solvent consisting of 95 parts water and 5 parts ethanol.

The amount of tobacco material which is contacted with the solvent can vary. Typically, the weight of solvent relative to the tobacco material is greater than 4:1, oftentimes greater than 5:1, and frequently greater than about 10:1. The amount of solvent relative to tobacco material depends upon factors such as the type of solvent, the temperature at which the extraction is performed, the type or form of tobacco which is extracted, the manner in which contact of the tobacco material and solvent is conducted, and other such factors. The manner of contacting the tobacco material and solvent is not particularly critical.

The conditions under which the extraction is performed can vary. Typical temperatures range from about 50° F. to about 175° F. The solvent/tobacco material mixture can be agitated (e.g., stirred, shaken or otherwise mixed) in order to increase the rate at which extraction occurs. Typically, adequate extraction of components occurs in less than about 60 minutes, and oftentimes in less than about 30 minutes. As such, an aqueous tobacco slurry is provided.

The solvent and tobacco components extracted thereby are separated from the insoluble residue. When the solvent has an aqueous character, the insoluble residue includes components of the biopolymer matrix of the tobacco material and other tobacco components which are not extracted by that solvent. The manner of separation of the components of the slurry can vary; however, it is convenient to employ conventional separation means such as filtration, centrifugation, pressing, or the like. Generally, the separation of the components of the slurry is performed while the slurry is maintained at above ambient temperature. It is desirable to provide a solution of solvent and tobacco extract having a very low level of suspended solids, while removing the greatest amount of solvent from the insoluble residue as is possible. Typically, the separation of the components of the aqueous tobacco slurry is performed in order to provide (i) a damp pulp having a low level or residual solubles; and (ii) an aqueous extract including tobacco extract components.

The pulp (i.e., the insoluble tobacco residue) is refined and formed into a sheet, or other desired shape. Typically, the pulp is laid onto a fabric or wire mesh belt using known papermaking techniques and equipment. Oftentimes, damp pulp is contacted with further aqueous liquid to provide a slurry of sufficiently low solids content so as to have the pulp in a slurry form which can be readily formed as a sheet on a fabric, screen or wire mesh belt. The formed pulp then is treated to remove excess water therefrom by passing the pulp through a series of presses, dryers, vacuum boxes, or the like. Techniques for removing excess water from formed pulp will be apparent to the skilled artisan. Preferably, the pulp includes extracted pieces of tobacco stem as a component thereof.

If desired, the pulp can be contacted with additives and/or treated so as to alter its chemical composition. The pulp can be combined with wood pulp fibers, flax fibers, calcium carbonate particles, carbonaceous particles, agglomerated calcium carbonate particles, calcium sulfate fibers, or the like, in a manner set forth in U.S. patent application Ser. No. 416,332, filed Sep. 29, 1989, now U.S. Pat. No. 5,056,537. Usually the amount of additive combined with the pulp does not exceed about 25 percent, and frequently does not exceed about 20 percent, of the dry weight of the pulp. Usually, an additive such as wood pulp or flax fibers is added to the tobacco pulp just prior to the time that the pulp is refined. The pulp also can be subjected to enzyme treatment as set forth in U.S. Pat. No. 4,887,618 to Bernasek, et al., heat treated, or otherwise processed to change the chemical composition of that material.

The liquid extract is provided at a desired soluble solids level, and normally is concentrated to achieve such a soluble solids level. Typically, the aqueous phase is evaporated such that the concentrated extract includes more than about 15 percent tobacco extract components, preferably about 20 to about 50 tobacco extract components, more preferably about 25 to about 40 percent tobacco extract components, based on the weight of the tobacco extract components and solvent. Techniques for concentrating liquid extracts will be apparent to the skilled artisan. For example, the liquid extract can be subjected to elevated temperatures and a slight vacuum. The liquid also can be subjected to heat treatment under essentially ambient conditions of pressure. For example, the liquid extract can be subjected to a temperature of about 180° F. to about 250° F., preferably about 190° F. to about 220° F., for about 10 minutes to about 90 minutes. If desired, the liquid extract can be spray dried, or otherwise processed to remove aqueous liquid therefrom and provide a tobacco extract in low solvent form, and then recombined with water to provide a liquid tobacco extract of a desired concentration.

The aqueous tobacco extract then most preferably is applied to the formed pulp. For example, the aqueous tobacco extract is uniformly applied to the pulp in a sheet-like form using a series of spray nozzles, a series of sizing rollers, or other such means. However, the manner of applying the aqueous extract is not particularly critical. Although not particularly critical, the moisture content of the pulp just prior to the time that the aqueous tobacco extract is applied thereto normally ranges from about 30 to about 80 percent, based on the weight of the pulp and moisture; and a formed pulp having a sheet-like shape is such that the dry weight thereof is about 3 grams to about 5 grams per square foot. The formed pulp having the aqueous tobacco extract applied thereto is dried to remove moisture therefrom using tunnel-type dryers, or the like. One or more applications of the aqueous extract can be provided to the formed pulp. As such, it is preferable that the tobacco extract is fairly uniformly distributed throughout the pulp. The amount of tobacco extract which preferably is applied to the pulp can vary. Typically, about 0.5 to about 1.5, preferably about 0.75 to about 1.25 parts of tobacco extract is applied to the pulp, based on the weight of the extract separated from the pulp during the extraction of the starting tobacco material. Normally, the extract is applied to the pulp in liquid form as an aqueous extract having a soluble solids content of about 20 to about 35 weight percent, and preferably about 25 to about 30 weight percent. The resulting reconstituted tobacco material is dried to a moisture content of about 10 to about 15 weight percent, preferably to a moisture content of about 12 to about 13 weight percent.

The reconstituted tobacco material employed to provide the tobacco-containing paper can vary. The manner in which the reconstituted tobacco material is manufactured can vary; however, it is most desirable that the tobacco material be subjected to suitable refining during reconstitution processing steps so as to provide refined tobacco pulp fibers useful in later papermaking steps. Exemplary reconstituted tobacco materials are those materials described in U.S. Pat. Nos. 4,270,552 to Jenkins et al.; 4,674,519 to Keritsis, et al.; 4,962,774 to Thomasson, et al.; 4,987,906 to Young, et al.; 5,056,537 to Brown, et al.; and 4,941,484 to Clapp, et al.; in U.S. patent application Ser. Nos. 461,216, filed Jan. 5, 1990; 647,329, filed Jan. 28, 1991, now U.S. Pat. No. 5,143,097; 710,273, filed Jun. 4, 1991, now U.S. Pat. No. 5,159,942; and 769,914, filed Sep. 30, 1991; and in *Tobacco Encyclopedia,* edit. by Voges, pp. 389–390, TJI (1984); which are incorporated herein by reference.

One method for making the tobacco-containing paper involves mixing water with the previously prepared reconstituted tobacco material, as well as inorganic filler particles and cellulosic pulp, and agitating the resulting mixture to provide an aqueous slurry having a water content of about 98 to about 99.5 weight percent. Normally, such a slurry is prepared in a papermaking chest equipped with a paddle-type mechanical stirrers; however, shearing devices which cause physical decomposition of the reconstituted tobacco material also an be employed. The resulting slurry can be transferred to a paper-making apparatus, such as a "Noble & Wood" sheet making mold having a stainless steel wire mesh screen. The slurry-containing mold can be gravity drained, pressed between water-removing felt belts, and the resulting sheet can be transferred to a flat-bed dryer set at about 100° C. As such, a tobacco-containing paper is provided.

Other paper making techniques also are described in U.S. Pat. Nos. 4,108,151 to Martin, et al.; 4,461,311 to Mathews, et al.; 4,450,847 to Owens; 4,805,644 to Hampl, Jr., et al.; 4,881,557 to Martin; 4,915,118 to Kaufman, et al.; and in U.S. patent application Ser. No. 541,007, filed Jun. 20, 1990, now abandoned. Other papermaking techniques and equipment, such as those employed by Ecusta Corp. and Kimberly-Clark Corp., can be employed.

The tobacco-containing paper normally includes more than about 40, usually more than about 50, and often more than about 60 percent tobacco material provided by the reconstituted tobacco material, on a dry weight basis. The paper normally includes up to about 30, usually up to about 40, and often up to about 50 percent tobacco material provided by the reconstituted tobacco material, on a dry weight basis. If desired, a portion of the reconstituted tobacco material (e.g., up to about 30 weight percent of the reconstituted tobacco material, based on the total dry weight of reconstituted tobacco material) can be provided by another tobacco material, such as tobacco laminae cut filler, tobacco dust, volume expanded tobacco laminae, tobacco fines, extracted tobacco laminae cut filler, tobacco stem pieces, processed tobacco stems, tobacco extracts and processed tobacco extracts, or the like, as well as combinations thereof.

The tobacco-containing paper can include a cellulosic material in addition to the tobacco material which is incorporated therein. Exemplary additional cellulosic materials include flax fibers, softwood pulp and hardwood pulp. The additional cellulosic material normally provides more than about 15, usually more than about 20, and often more than about 25 percent of the paper, on a dry weight basis. The additional cellulosic material normally provides up to about 50, usually up to about 60, and often up to about 70 percent of the paper, on a dry weight basis.

The tobacco-containing paper most preferably includes an inorganic filler material, and particularly an essentially water insoluble material. Particularly preferred are essentially water insoluble salts. Exemplary inorganic filler materials include talc, clay, titanium dioxide or calcium carbonate particles, calcium sulfate fibers, particles of calcium sulfate, magnesium oxide, magnesium hydroxide, as well as the agglomerated filler materials and those other filler materials described in U.S. patent application Ser. No. 567,520 filed Aug. 15, 1990, now U.S. Pat. No. 5,105,836, which is incorporated herein by reference. Carbonaceous particles also can be employed filler materials. Combinations of inorganic filler materials can be employed. For example, a mixture of calcium carbonate particles and a precipitate magnesium hydroxide gel can be employed to provide the inorganic filler component of the paper. The inorganic filler material normally provides more than about 5, usually more than about 10, and often more than about 15 percent of the paper, on a dry weight basis. The inorganic filler material normally provides up to about 40, usually up to about 30, and often up to about 20 percent of the paper, on a dry weight basis.

The tobacco-containing paper can include a water soluble salt additive. Examples of such salt additives include inorganic salts (e.g., potassium chloride and potassium nitrate) and salts having inorganic cations (e.g., potassium citrate, potassium acetate, potassium malate, potassium propionate and potassium succinate). The water soluble salt additive normally provides up to about 12 percent, usually up to about 8 percent, and often up to about 5 percent of the paper, on a dry weight basis. Such water soluble salt additive can be incorporated into the paper during the manufacture thereof, or after the paper is manufactured using size press or printing techniques.

The moisture content of the tobacco-containing paper can vary. Typically, the paper has a moisture content of about 3 to about 14 percent, based on weight of that paper.

The inherent permeability of the tobacco-containing paper can vary. Generally, the inherent permeability of the paper is above about 10 CORESTA units, often above about 50 CORESTA units, and frequently above about 100 CORESTA units; although the permeability of that paper can approach 1000 CORESTA units. The paper can be perforated (e.g., mechanically or electrostatically perforated) to provide the desired net permeability.

The basis weight of the tobacco-containing paper can vary. Generally, the basis weight of the paper is greater than about 30 g/m$^3$, often greater than about 40 g/m$^3$, based on the dry weight of the paper. The basis weight of the paper normally does not exceed about 100 g/m$^3$, and usually is less than about 80 g/m$^3$, based on the dry weight of the paper.

Typical papers have a water-soluble tobacco extract/water insoluble tobacco pulp weight ratio of less than about 0.5, often less than about 0.4, and frequently less than about 0.25. A desirably high ratio of extract/pulp provides for a tobacco-containing paper having acceptable organoleptic characteristics. A desirably low ratio of extract/pulp provides for a tobacco-containing paper having acceptable physical properties, including a desirably high tensile strength.

One preferred paper includes about 50 to about 65 weight parts reconstituted tobacco material, about 10 to about 20 weight parts calcium carbonate filler, and about 25 to about 35 weight parts wood pulp. Such a preferred paper has a basis weight of about 40 to about 65 g/m$^3$, and a moisture content of about 5 to about 10 weight percent. One preferred paper exhibits a tensile strength above about 2000 g/m$^3$, and an inherent porosity of about 40 to about 70 CORESTA units.

The paper can be further treated so as to provide a further material in intimate contact therewith. For example, flavors, humectants, aerosol forming materials, extracts and salts can be applied using size press techniques, spraying techniques, or printing techniques or the like. The technique used to apply to particular material to the paper can vary, depending upon the type and amount of material applied.

The tobacco-containing papers which are manufactured according to the process of the present invention have many desirable characteristics. Such papers have many of the desirable characteristics and physical properties of good quality papers made from wood pulp and/or flax fibers; however, such papers also can exhibit many of the smoking properties and possess many of the desirable organoleptic characteristics of tobacco laminae and reconstituted tobacco materials. Such papers have a desirable opacity, color, smoothness and flatness, and are absent of the wrinkles and inconsistent surface character characteristic of reconstituted tobacco materials. Such papers can have a controlled caliper, and can exhibit high tensile and tear strengths. Exemplary papers have tensile strengths greater than about 1000 g/m$^3$. Often greater that about 1500 g/m$^3$, and frequently greater than about 2000 g/m$^3$. Preferred papers are of such a character that such papers can be manufactured, wound into rolls, and slit into bobbins. Preferred papers can be used effectively to manufacture components for various smoking articles using rod making equipment commonly used in the cigarette making industry.

The following examples are provided in order to further illustrate the invention but should not be construed as limiting the scope thereof. Unless otherwise noted, all parts and percentages are by weight.

EXAMPLE 1

A. Manufacture of a Reconstituted Tobacco Material

A reconstituted tobacco material is provided using a papermaking process generally as described with reference to FIG. 1 using a blend of tobacco types. The blend includes about 65 parts Burley and flue-cured tobacco stem pieces and about 35 parts of tobacco laminae processing by-products.

The tobacco blend is extracted batch-wise at about 130° F. using about 10 to about 15 parts tap water for each part tobacco material. Aqueous tobacco extract is separated from the water insoluble pulp using a centrifuge. The aqueous extract so provided has a soluble solids content of about 5 percent, and is concentrated to a soluble solids content of about 22 to about 28 percent using a wiped film evaporator.

The pulp, which has a very low remaining water extractables content, is provided as a slurry in water at a solids content of about 2 to about 3 percent and refined in a conical refiner to a Canadian Standard Freeness of about 50 to about 200 ml. The refined slurry is diluted using recirculated forming water from the papermaking process to provide a diluted slurry having a solids content of about 0.5 to about 1 percent. The diluted slurry is formed into a sheet on a fabric belt of a papermaking apparatus, the operation of which will be apparent to the skilled artisan. The pulp is formed into a sheet having a dry basis weight of about 40 to about 50 g/m$^3$. A vacuum is pulled on the bottom of the fabric belt as is common in the papermaking industry so as to provide a damp, formed pulp having a moisture content of about 85 percent. The formed pulp is passed through a roller press to provide a damp pulp having a moisture content of about 60 to about 65 percent.

The previously described liquid extract is sprayed onto one side of the sheet which is formed from the insoluble pulp. The sheet then is subjected to convection heating at greater than about 300° F. to dry the sheet to a moisture content of about 55 to about 70 percent. Then, the previously described extract is sprayed onto the other side of the sheet. Convection drying of the sheet is continued until the moisture content of the reconstituted tobacco sheet is about 12 to about 13 percent.

The resulting reconstituted tobacco material exhibits a pulp content of about 65 percent, and a tobacco extract content of about 35 percent, on a dry weight basis. The reconstituted tobacco material has a dry weight basis weight of about 12 g/ft$^3$, and a thickness approximately that of aged tobacco leaf laminae (e.g., about 400 microns). The reconstituted tobacco material is broken into "strip" form.

B. Manufacture of a Tobacco-Containing Paper

The reconstituted tobacco material is provided as a slurry in water. In particular, about 50 parts of the reconstituted tobacco material, about 16 parts low surface area calcium carbonate particles and about 34 parts softwood pulp is mixed with water, agitated so as to cause deformation of the reconstituted tobacco material into dispersed pulp fibers and soluble extract, and formed into a paper using hand sheet papermaking equipment. That is, the slurry is drained through a screen, pulp is collected, and the collected sheet is dried. The resulting sheet has a basis weight of 60 g/m$^3$, an SR Freeness of about 563 ml, a 1.767 gm fiber weight length, an inherent porosity of about 90 CORESTA units, and a water soluble tobacco extractables content of about 10 percent.

EXAMPLE 2

A tobacco-containing paper is provided essentially as described in Example 1. However, the reconstituted tobacco, which is similarly prepared, material does not have tobacco extract applied thereto. The reconstituted tobacco material has water soluble tobacco extractables content of about 10 percent, and a basis weight of about 8 g/ft$^3$. The tobacco-containing paper is provided from about 50 parts of the reconstituted tobacco material, about 16 parts of the calcium carbonate particles and about 34 parts softwood pulp. The paper has a basis weight of about 48 g/m$^3$, an SR Freeness of about 563 ml, a 1.1767 gm fiber weight length, an inherent porosity of about 105 CORESTA units, and a water soluble tobacco extractables content of about 9 percent.

What is claimed is:

1. A process for manufacturing tobacco-containing paper, the process comprising the steps of:
   (a) providing a dried reconstituted tobacco material including water insoluble material;
   (b) contacting the dried reconstituted tobacco material with water to provide an aqueous tobacco slurry including water insoluble pulp; and
   (c) processing the slurry provided in step (b) to manufacture a tobacco-containing paper such that the paper includes the water insoluble pulp and contains more than 40 percent tobacco material provided by the reconstituted tobacco material, on a dry weight basis.

2. The process of claim 1 whereby in step (b) the reconstituted tobacco material and water are combined with an inorganic filler to provide the tobacco-containing paper.

3. The process of claim 1 whereby the reconstituted tobacco material is provided using a papermaking technique.

4. The process of claim 1 whereby the tobacco-containing paper includes more than about 50 percent tobacco material provided by the reconstituted tobacco material, on a dry weight basis.

5. The process of claim 3 whereby the water insoluble pulp has been refined.

6. The process of claim 1 whereby in step (b) the reconstituted tobacco material and water are combined with a cellulosic material.

7. The process of claim 1 whereby in step (b) the reconstituted tobacco material and water are combined with an inorganic filler and a cellulosic material.

* * * * *